US005918647A

United States Patent [19]

Liaw

[11] Patent Number: 5,918,647

[45] Date of Patent: Jul. 6, 1999

[54] AUTOMATIC FLUID CHANGING DEVICE

[76] Inventor: Bo-Lin Liaw, 128, Chung-Mei St., West Dis., Taichung, Taiwan

[21] Appl. No.: 09/009,878

[22] Filed: Jan. 21, 1998

[51] Int. Cl.[6] ..... F16N 33/00

[52] U.S. Cl. ..... 141/98; 141/91; 141/67; 184/1.5; 184/6.4; 134/169 A

[58] Field of Search ..... 141/59, 67, 91, 141/98; 184/1.5, 6.4, 96, 105.1; 134/169 A

[56] References Cited

U.S. PATENT DOCUMENTS

| | | | |
|---|---|---|---|
| 1,962,463 | 6/1934 | Renfrew | 184/1.5 |
| 5,289,837 | 3/1994 | Betancourt | 134/169 A |
| 5,318,080 | 6/1994 | Viken | 141/98 |
| 5,370,160 | 12/1994 | Parker | 141/98 |
| 5,390,762 | 2/1995 | Nelson | 184/1.5 |
| 5,413,716 | 5/1995 | Osborne | 184/1.5 |
| 5,447,184 | 9/1995 | Betancourt | 141/98 |
| 5,472,064 | 12/1995 | Viken | 184/1.5 |
| 5,522,474 | 6/1996 | Burman | 184/1.5 |
| 5,615,716 | 4/1997 | Akazawa | 141/91 |
| 5,626,170 | 5/1997 | Parker | 141/98 |
| 5,641,003 | 6/1997 | Rey et al. | 141/98 |
| 5,685,396 | 11/1997 | Elkin et al. | 184/1.5 |
| 5,743,357 | 4/1998 | Few | 184/1.5 |
| 5,746,259 | 5/1998 | Noble, III | 141/67 |
| 5,772,402 | 6/1998 | Goodman | 141/98 |
| 5,787,372 | 7/1998 | Edwards et al. | 184/1.5 |

*Primary Examiner*—J. Casimer Jacyna
*Attorney, Agent, or Firm*—Bacon & Thomas, PLLC

[57] ABSTRACT

The present invention relates to an automatic fluid changing device with which the fluid changing and cleaning work for the fluid line of the engine can be readily performed. An exchanging circuit is disposed between the fluid line of the engine and that is provided with a metal dual power cylinder. The power cylinder is connected with a flow meter and regulating valve such that the cleaning and/or fluid changing job can be readily conducted. The automatic fluid changing device features a compact and durable configuration.

1 Claim, 3 Drawing Sheets

AUTOMATIC FLUID CHANGING DEVICE

FIELD OF THE INVENTION

The present invention relates to a fluid changing device, more particularly, to an automatic fluid changing device with which the fluid changing work can be readily performed.

DESCRIPTION OF PRIOR ART

In general, the mechanism or engine is suffered with wearing during the operation or it needs fluid for power transmission, accordingly, the fluid needs to be replaced after a given period of usage. By this arrangement, the fluid line can be kept cleanly and will not be plugged.

However, as the fluid lines are arranged internally, and a heat exchanger is disposed externally. Accordingly, the fluid can be readily replaced and the performance can be increased. In light of this, a plurality of fluid changing devices has been introduced into the market. Consequently, the used fluid can be efficiently replaced by that fluid changing device. As a result, the fluid changing work can be readily and conveniently conducted and the efficiency can be also increased.

As shown in FIG. 1, a conventional fluid changing device is provided. This fluid exchanging device comprises a power cylinder 20 that is disposed within the fluid line 11 of the engine or transmission case 10. The power cylinder 20 includes a simple piston 21. By corporation with a pump 22, the power cylinder 20 may readily complete the fluid changing job. However, the overall configuration is quite complicate and the power cylinder 20 is made from transparent glass material for readily monitoring. However, as the contacting area between the piston 21 and the power cylinder 20 is quite large, and the piston 21 could be readily inclined and a jam therebetween will be occurred. Adversely, the power cylinder 20 can be broken into pieces. Consequently, the overall configuration will loss its function and this is really a mature product.

SUMMARY OF THE INVENTION

It is the objective of this invention to provide an automatic fluid changing device with which the problems and difficulties encountered by the conventional art can be efficiently solved.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
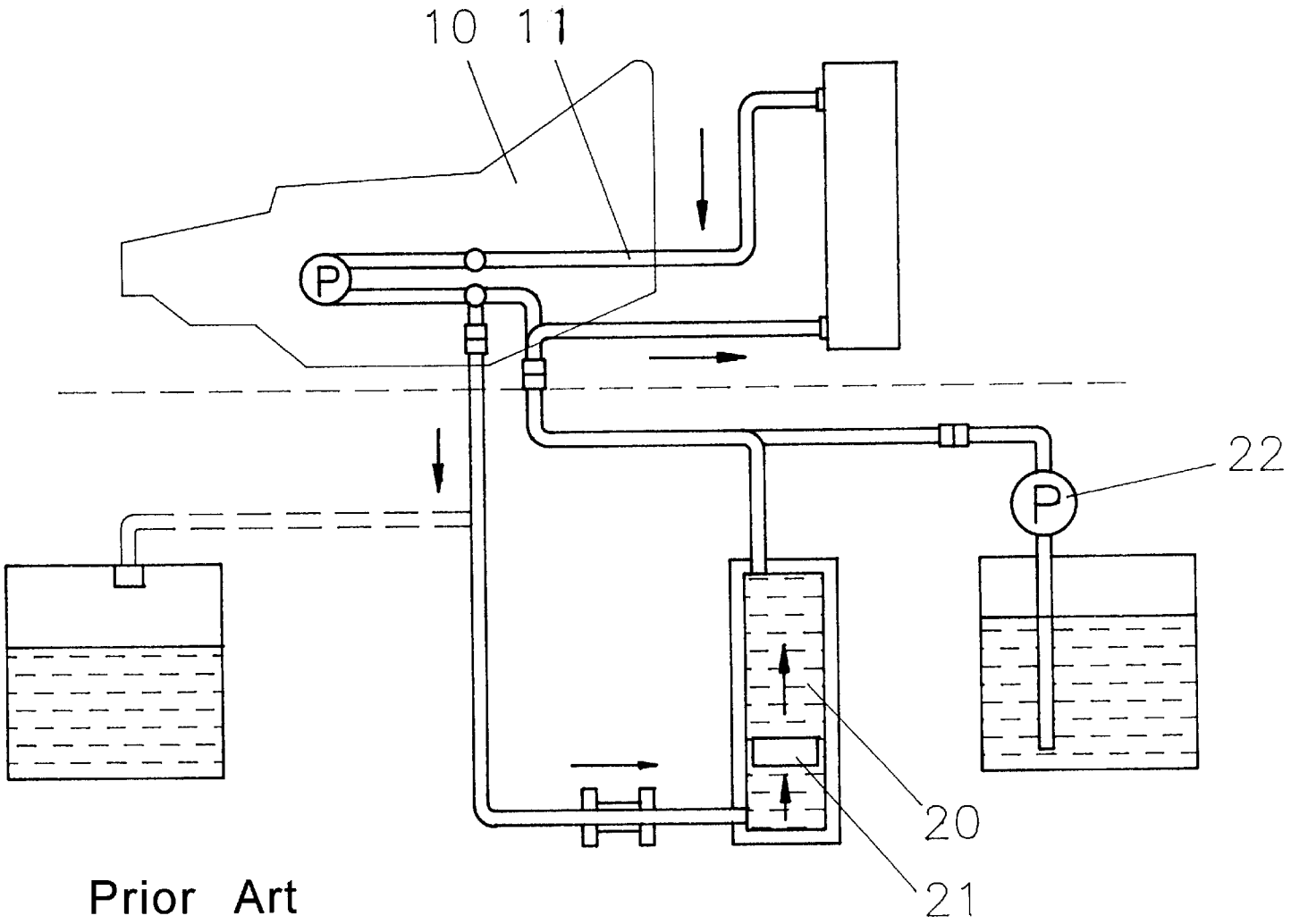
Fig 1 Prior Art
FIG. 1 is a schematic illustration of a conventional fluid changing device.
Figure 2:
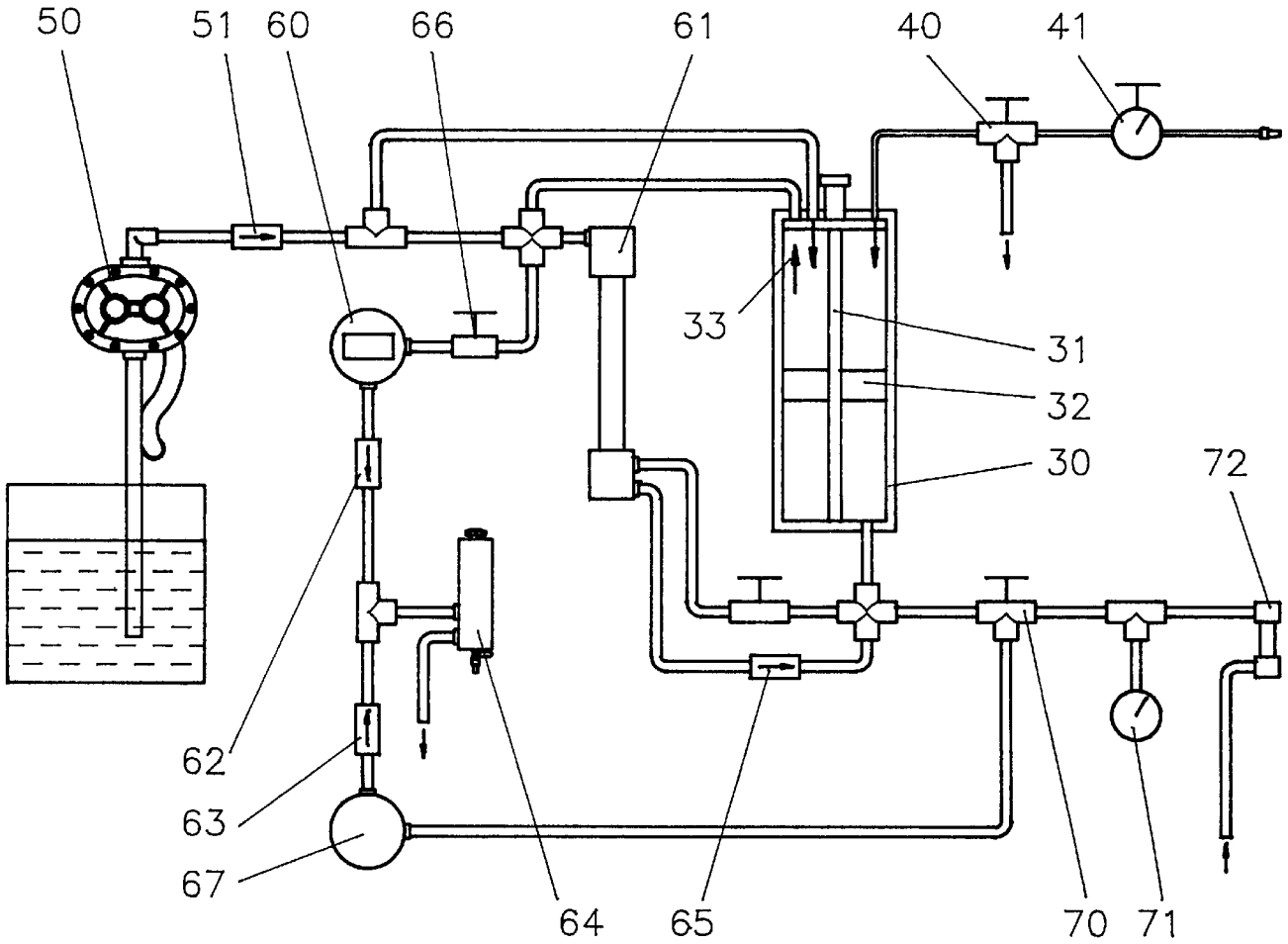
FIG. 2 is a schematic illustration of the automatic fluid changing device made according to the present invention.
Figure 3:
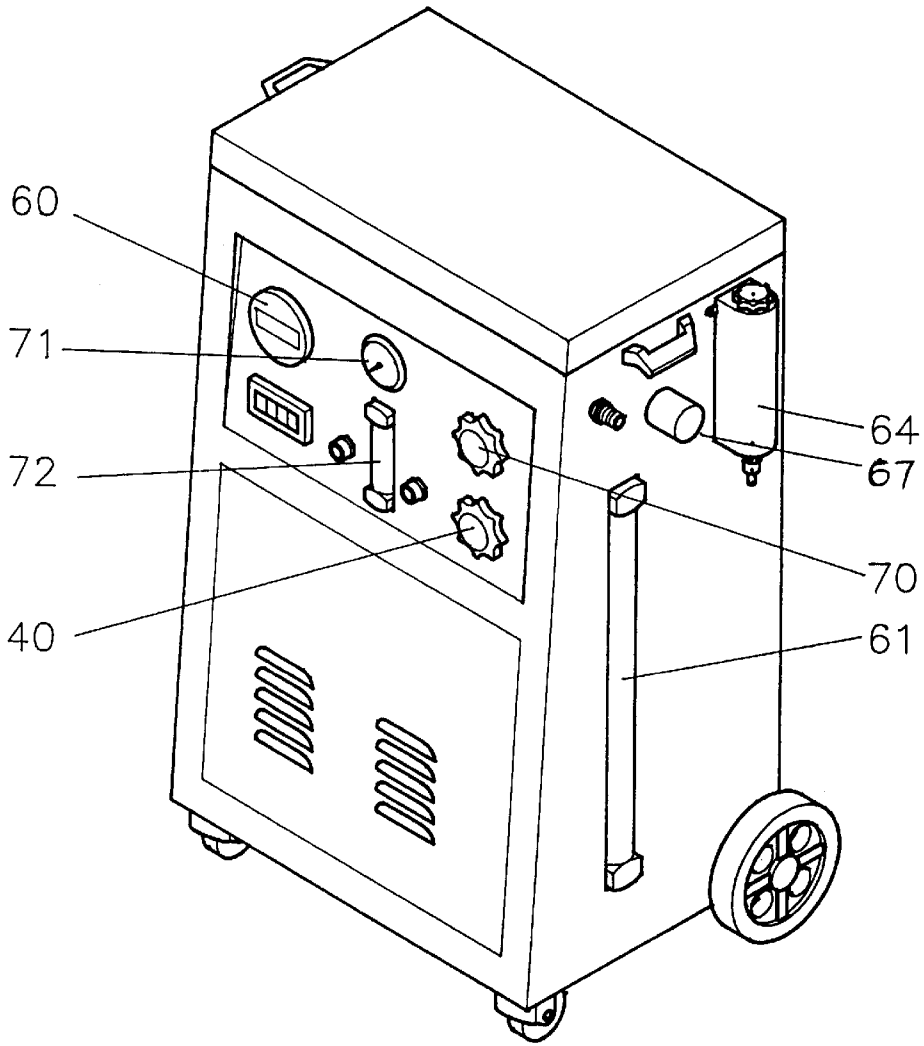
FIG. 3 is a perspective view of the fluid changing device shown in FIG. 2.

Referring to FIGS. 2 and 3, the schematic illustration and perspective view of the fluid changing device are respectively shown. The fluid changing device generally comprises a power cylinder 30 that is made from metal material. The power cylinder 30 includes a guiding shaft 31 therein. A piston 32 is disposed within said power cylinder 30 in a manner such that said piston 32 can be readily guided by the guiding shaft 31. The cylinder 30 further includes a discharging port 33 thereof The other end of the power cylinder 30 is connected to a valve 40, oil pump 50, flow meter 60. The valve 40 is connected to a regulating valve 41 that is connected to a pressure source. A check valve 51 is disposed between the power cylinder 30 and the oil pump 50. The flow meter 60 and a flow meter gauge 61 are connected thereof in parallel. A check valve 65 is also disposed between the check valve 51 and the flow meter gauge 61. A switch valve 66 is disposed at the right side of the flow meter 60. The rear portion of the flow meter 60 is provided with an oil tank 64 by means of a pair of check valves 62, 63. The tank 64 is provided with a filter 67 thereof The other end of the power cylinder 70 is connected to the cycling valve 70. The cycling valve 70 is connected with a pressure gauge 71 and a window 72. The other end of the cycling valve 70 is connected to the check valve 63 and the flow meter gauge 61. By this arrangement, the fluid changing device is therefore attained.

The main feature of the present invention is the power cylinder 30 is provided with a guiding shaft 31 such that the piston 32 is properly guided without any offset or misalignment during its displacement within the power cylinder 30. When the power line is to clean, the window 72 and the oil tank 64 can be connected respectively to the engine or transmission case in serial. Then the fluid line can be readily cleaned by the circulating fluid and the debris can be effectively strained by the filter 67. On the other hand, the fresh fluid or additive can be refilled through the oil tank 64. On the other hand, the used oil or fluid can be readily pumped in by the oil pump 50. Meanwhile, the used oil can be sucked into the power cylinder 30 through the window 72. Then the power cylinder 30 is actuated by means of hydraulic or pneumatic pressure such that the fresh oil can be directed into the engine through the oil tank 64 and the discharging port 33 of the power cylinder 30. The overall configuration is tough and durable. The operation procedure is also simplified.

From the forgoing description, the cleaning and refilling job can be readily conducted by the automatic fluid changing device that is configured by a power cylinder, that is configured by a valve, oil pump, and flow meter.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. An automatic fluid changing device, comprising a metal power cylinder having a guiding shaft disposed therein, a piston being disposed within said power cylinder in a manner such that said piston can be readily guided by said guiding shaft, said power cylinder further including a discharging port thereof, one end of said power cylinder being connected to a valve, said valve being connected to a regulating valve that is connected to a pressure source, said one end of said power cylinder further being connected to an oil pump and the first ends of a flow meter and a flow meter gauge in parallel, with a switch valve being disposed between said power cylinder one end and said flow meter, the other end of said power cylinder being connected to the second ends of said flow meter and flow meter gauge and a cycling valve, one end --; of said cycling valve being connected to a pressure gauge and a window, the other end of said cycling valve being connected to said flow meter gauge with an oil tank and a filter being disposed between said power cylinder other end and said second end of said flow meter.

* * * * *